US012049890B2

(12) United States Patent
Lee

(10) Patent No.: US 12,049,890 B2
(45) Date of Patent: Jul. 30, 2024

(54) FLUID PUMP WITH PRESSURE RELIEF PATH

(71) Applicant: FLUID METERING, INC., Syosset, NY (US)

(72) Inventor: Daniel Lee, East Elmhurst, NY (US)

(73) Assignee: FLUID METERING, INC., Syosset, NY (US)

( * ) Notice: Subject to any disclaimer, the term of this patent is extended or adjusted under 35 U.S.C. 154(b) by 235 days.

(21) Appl. No.: 17/442,438

(22) PCT Filed: Oct. 8, 2020

(86) PCT No.: PCT/US2020/054738
§ 371 (c)(1),
(2) Date: Sep. 23, 2021

(87) PCT Pub. No.: WO2021/194551
PCT Pub. Date: Sep. 30, 2021

(65) Prior Publication Data

US 2023/0141287 A1 May 11, 2023

Related U.S. Application Data

(60) Provisional application No. 63/000,914, filed on Mar. 27, 2020.

(51) Int. Cl.
*F04B 7/00* (2006.01)
*F04B 7/06* (2006.01)
(Continued)

(52) U.S. Cl.
CPC ..... *F04B 7/0088* (2013.01); *F04B 53/14* (2013.01); *F04B 7/0007* (2013.01); *F04B 7/0011* (2013.01);
(Continued)

(58) Field of Classification Search
CPC ..... F04B 7/0088; F04B 53/14; F04B 53/16; F04B 7/0007; F04B 7/0011; F04B 7/04;
(Continued)

(56) References Cited

U.S. PATENT DOCUMENTS 5,385,992 A * 1/1995 Koskinen ..... B01J 8/003 526/86
2007/0256556 A1* 11/2007 Rawlings ..... F16J 15/324 92/165 R
(Continued)

FOREIGN PATENT DOCUMENTS

| | | |
|---|---|---|
| GB | 1261826 | 1/1972 |
| WO | WO2019089912 A1 | 5/2019 |
| WO | WO2019152824 A1 | 8/2019 |

*Primary Examiner* — Charles G Freay
*Assistant Examiner* — David N Brandt
(74) *Attorney, Agent, or Firm* — Hoffmann & Baron LLP

(57) ABSTRACT

A liquid pump including a pump housing having an interior sidewall forming an interior. The housing has an inlet port and an outlet port. A liner is disposed in the interior and has opposed transverse openings in line with the inlet and outlet ports. The liner has a central longitudinally extending bore. A pump piston is axially and rotatably slidable within the liner longitudinal bore for pumping the liquid from the inlet port to the outlet port. A seal assembly is secured to the pump housing adjacent to an upper end of the liner. The seal assembly including a seal body, an upper end of the piston extending though the cap and in sealing engagement with the seal body, the seal assembly and liner upper end forming a cavity there between. An upper end of the piston extending though the seal assembly and in sealing engagement with the seal body, the seal body and liner upper end forming a cavity there between. The housing having a passageway providing a fluid communication between the cavity and the inlet port.

16 Claims, 6 Drawing Sheets

(51) Int. Cl.
*F04B 13/00* (2006.01)
*F04B 53/14* (2006.01)
*F04B 53/16* (2006.01)

(52) U.S. Cl.
CPC ..... *F04B 7/06* (2013.01); *F04B 13/00* (2013.01); *F04B 53/162* (2013.01); *F04B 53/166* (2013.01)

(58) Field of Classification Search
CPC ..... F04B 7/06; F04B 13/00; F04B 53/008; F04B 53/162; F04B 53/166
See application file for complete search history.

(56) References Cited

U.S. PATENT DOCUMENTS

| | | | | |
|---|---|---|---|---|
| 2010/0301069 | A1* | 12/2010 | Bensley | F04B 53/16 222/372 |
| 2016/0123312 | A1* | 5/2016 | Middleton | F04B 13/00 417/500 |
| 2017/0218950 | A1 | 8/2017 | Mizukoshi | |

* cited by examiner

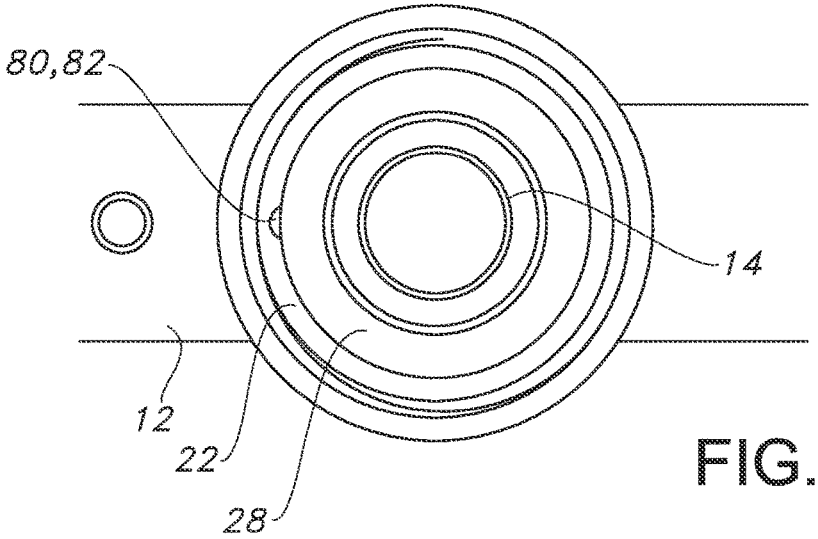
FIG. 3
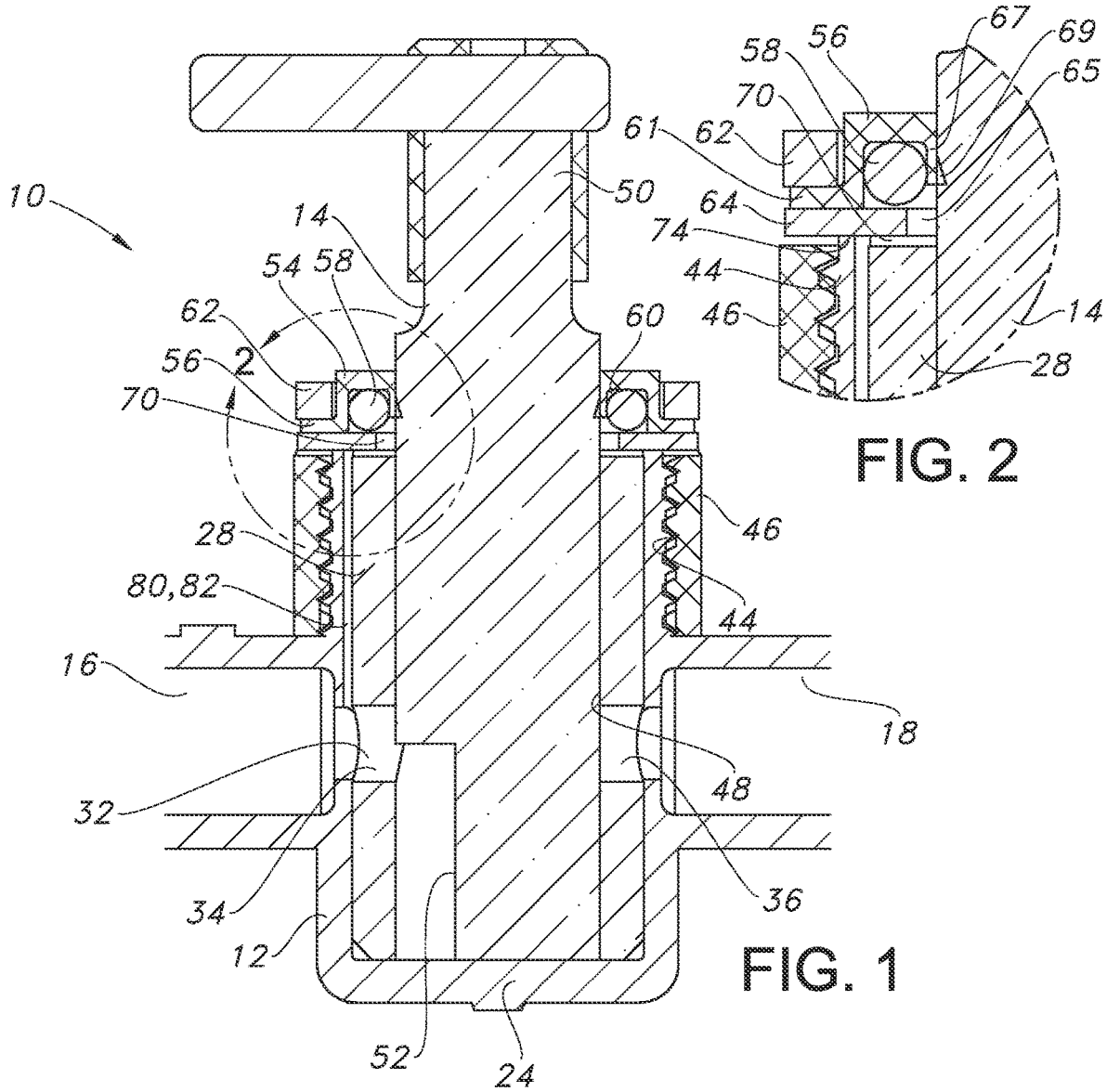
FIG. 2
FIG. 1

FLUID PUMP WITH PRESSURE RELIEF PATH

CROSS-REFERENCE TO RELATED APPLICATIONS

This application is a National Phase application of International Application No. PCT/US20/54738 filed Oct. 8, 2020, which claims priority from U.S. Provisional Patent Application No. 63/000,914 filed Mar. 27, 2020, the disclosures of which are incorporated herein in their entirety for all purposes.

BACKGROUND

The present disclosure relates generally to liquid pumping systems, wherein one liquid is pumped or fed into the stream of another liquid. More particularly, the present invention relates to a liquid pump with a liquid reservoir and modified pressure relief slot to minimize leaking.

There are situations in which it is necessary to inject or feed one liquid into the stream of another liquid. Some liquid pumping systems require an occasional injection of liquid while others need a more continuous feed of the liquid. Still others might require a combination of the two. For purposes of this disclosure, it is understood that the term "feed" will include inject.

One such common application is in the field of water treatment wherein certain chemicals, such as chlorinating solutions, fluorination chemicals and other liquids, are fed into the water stream at a point prior to its delivery for end use by consumers. It is important to maintain certain percentage levels of these added liquids in order to assure adequate functionality without exceeding predetermined concentrations which could be objectionable or even harmful to the consumer.

A variety of apparatus is available in the industry to perform this chemical feed task. Such apparatus typically takes the form of a pump, wherein pump speed and chemical feed rate is controlled by well known electronic means which employs chemical concentration detection means and provides voltage or current signal output for use by the pump drive system to adjust its feed rate. This system operates in a closed loop fashion to maintain a relatively stable concentration of the desired chemical in the water stream.

Pumps used to inject chlorinating solutions, such as Sodium Hypochlorite (NaOCl), into a pressurized water stream frequently encounter problems associated with crystallization of the NaOCl. Although crystallization, with its tendency to lock parts, has been previously considered in various pump designs, the abrasive nature of these crystals was not thoroughly considered.

Positive displacement pumps having a ceramic piston and a liner are often plagued with consequential problems arising from such abrasive crystals. During normal pump operation, the piston will rotate and reciprocate in and out of the pump head. Upon outward movement of the piston, suitably designed sealing elements will wipe the piston surface to minimize dragging of any pumped liquid out of the pump head. This squeegee action of the seals is not, however, perfect. Some liquid is always present as a film on the exposed piston surface.

This primary difficulty occurs most often in those installations where the NaOCl injection pump does not run continuously. In such applications, the pump might run for as little as one (1) hour and then be allowed to sit idle for the next twenty-three (23) hours. If the piston is partially or fully withdrawn from its mating pump head during such idle time, the previously described NaOCl film will dry, resulting in hard, abrasive crystals forming on the piston surface. At this point, the piston surface can be likened to a nail file with a fine abrasive.

When the pump next begins to run, the piston having the newly formed abrasive surface will travel past the seal elements on its way into the pump head. This has been found to prematurely wear the seal elements such that they gradually lose the ability to perform their squeegee action on the piston. This in turn leads to an increase in crystallization during idle time and ultimate failure of the seal.

Once seals have been sufficiently worn, additional problems arise during idle time. NaOCl injection pumps of the type being addressed typically utilize a slight negative pressure of approximately 1-2 psig on the inlet port to preclude leakage of NaOCl out of the pump head during idle times. Pumps of the prior art typically include a pressure relief slot, also known as a "scavenger slot," to provide for such negative pressure. However, the combination of a worn seal with a pressure relief slot allows the negative pressure to aspirate air into the pump head. This air flow will gradually lead to evaporation of NaOCl liquid within the pump head such that crystallization will cause the piston to lock and be unmovable when the pump is later energized.

Design of the pump drive mechanism can be such as to assure full piston insertion into the pump head during idle time but such mechanisms add considerably to complexity, size and cost.

Previous attempts to address the problem of the prior art have been attempted. For example, as shown in U.S. Pat. No. 9,261,085, a slot is cut on the inside of a liner from the inlet port up to the top of the liner where there is an annular liquid reservoir. This allows the liquid to travel down the slot preventing the cavity from filling up.

An internal groove version has also been developed as another solution to the problem. A slot is formed on the inner diameter of the liner and starts at the inlet port but does not go up to the top of the liner. Instead an annular liquid reservoir is made inside the liner bore located between the port and the top of the liner. The slot is made up to the groove and provides the same pressure relief.

However, these designs require a larger overall clearance between the piston and liner, an open path between the inlet port and top of the liner and difficulty in measuring the clearance of the piston/liner set.

Therefore, it would be desirable to provide an effective solution to the crystallization and leakage problems described above, with minimum cost and without increasing size or complexity of the pump. More particularly, it would be desirable to provide a simply designed pump with provisions for reducing leakage at the seal and piston interface and that relieves using a relatively thin walled liner.

SUMMARY

The present disclosure provides a liquid pump including a pump housing having an interior sidewall forming an interior. The housing has an inlet port and an outlet port. A liner is disposed in the interior and has opposed transverse openings in line with the inlet and outlet ports. The liner has a central longitudinally extending bore. A pump piston is axially and rotatably slidable within the liner longitudinal bore for pumping the liquid from the inlet port to the outlet port. A seal assembly is secured to the pump housing adjacent to an upper end of the liner. The seal assembly including a seal body, an upper end of the piston extending though the seal assembly and in sealing engagement with the seal body. The seal assembly and liner upper end form a cavity there between. An upper end of the piston extending though the seal assembly and in sealing engagement with the seal body, the seal body and liner upper end forming a cavity there between. The housing having a passageway providing a fluid communication between the cavity and the inlet port.

The present disclosure also provides a liquid pump including a pump housing defining a central longitudinal bore. A transverse bore communicates with the central bore for conveying a liquid through the pump housing. A pump piston is axially and rotatably slidable disposed within the central longitudinal bore for pumping the liquid through the transverse bore. The piston and housing define a cavity therebetween and the housing includes a passageway in fluid communication with the cavity and the inlet port.

The disclosure further provides a method for reducing leakage of a liquid pump including the steps of:

- creating a negative pressure at an inlet of a pump housing of the pump with a piston axially movable within a liner disposed in a central bore of the pump housing;
- creating a positive pressure at an outlet of the pump housing with the piston; and
- transferring fluid from a cavity formed in the pump housing to and from the inlet via a passageway formed in the pump housing extending between the inlet and the cavity.

BRIEF DESCRIPTION OF DRAWINGS

FIG. 1 is cross-sectional view of first embodiment of fluid pump.

FIG. 2 is a detail cross-sectional view taken from FIG. 1.

FIG. 3 is a top plan view of the pump embodiment of FIG. 1.

DETAILED DESCRIPTION

Figure 1A:
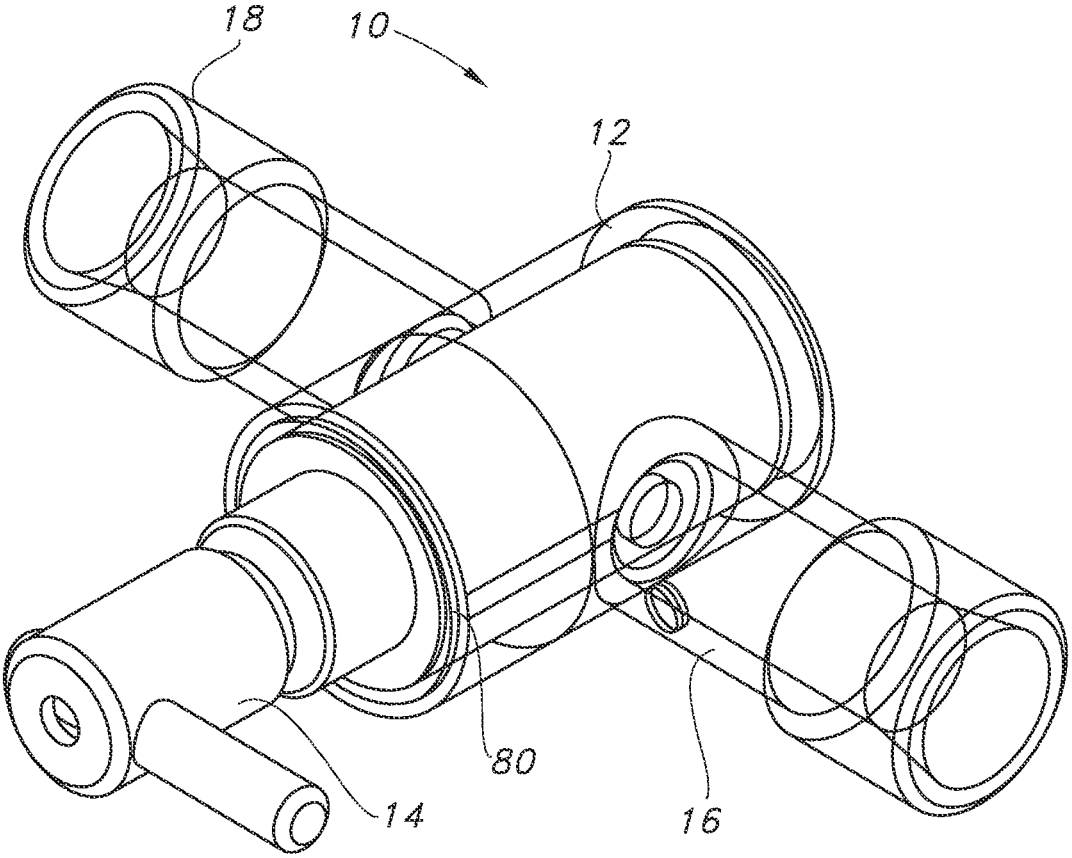
FIG. 1A is a perspective view of a fluid pump of the present disclosure.

With reference to FIGS. 1 to 6, a fluid pump 10 generally includes a pump housing 12 and a piston 14 disposed within. The pump housing 12 has an inlet port 16, an outlet port 18. The inlet 16 and outlet 18 ports are connectable to fluid conduits (not shown) operably connected to the ports for supplying fluid to and carrying fluid away from the pump 10. The pump housing defines a cylindrical chamber 20 in fluid communication with the inlet and outlet ports 16 and 18. The chamber 20 has a sidewall 22 extending between an enclosed bottom end 24 and an open upper end 26. The sidewall 22 has a surface 25 that is exposed to and defines the housing chamber 20.

Received in the cylindrical chamber 20 is a ceramic piston liner 28 having a central longitudinally extending bore 30 and a transverse bore 32 communicating with the longitudinal bore. The transverse bore 32 includes opposed transverse openings including an inlet portion 34 fluidly communicating with the outlet port 18 of the pump housing so that a liquid, such as a chlorine solution, can be pumped from the inlet port, through the liner, to the outlet port in a manner as will be described below.

Figure 4:
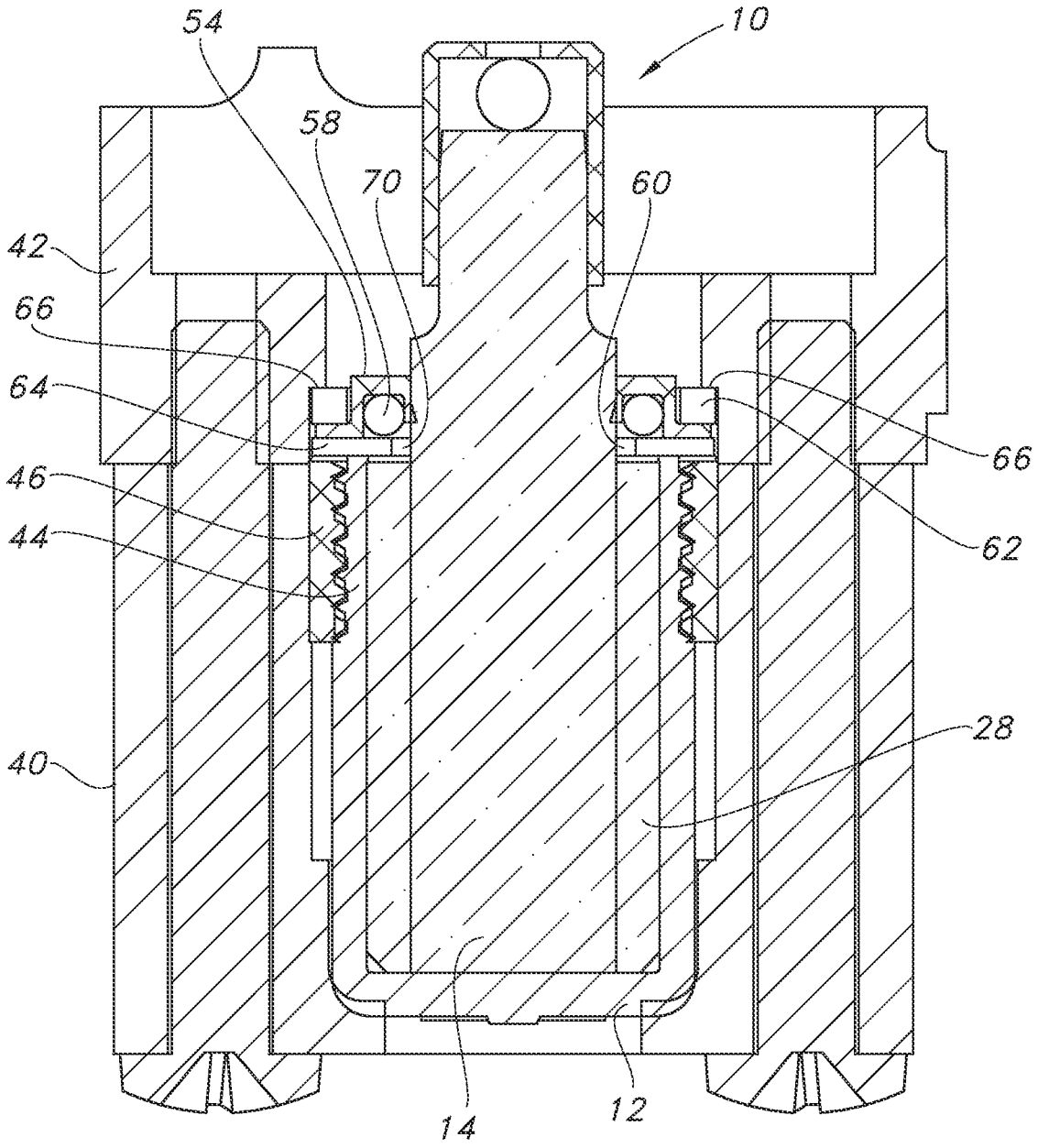
FIG. 4 is a cross-sectional view of the pump in a base assembly.
Figure 5:
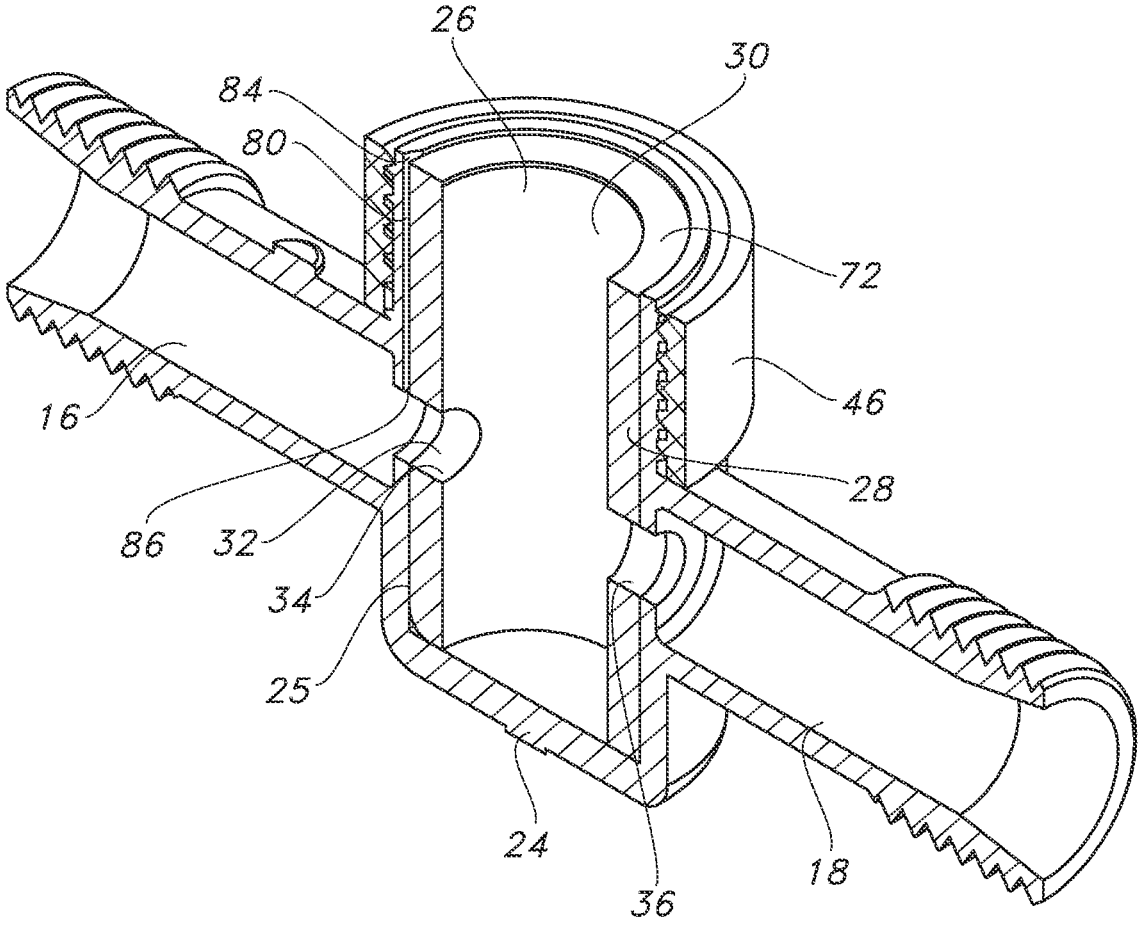
FIG. 5 is a cross-sectional view of the pump housing with a liner.
Figure 6:
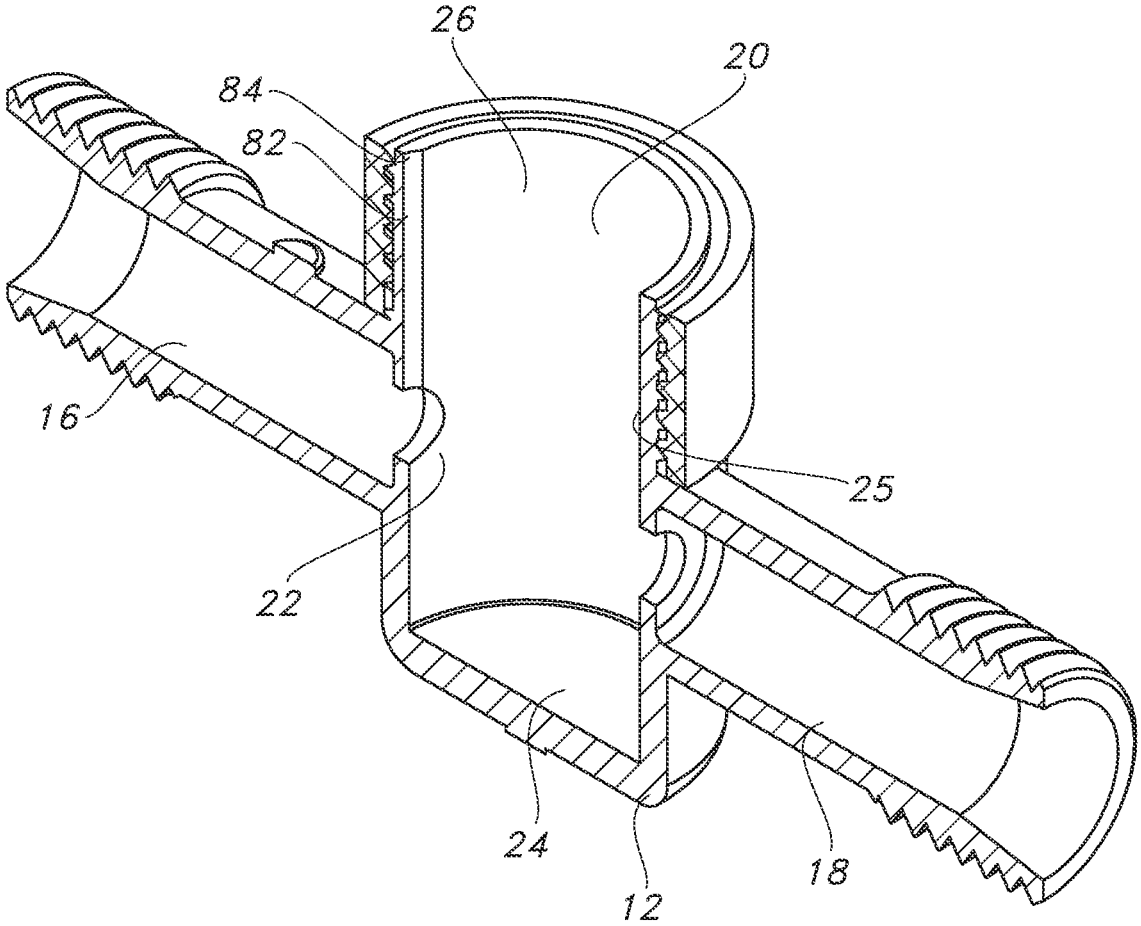
FIG. 6 is a cross-sectional view of the pump housing with the liner removed.

With reference to FIG. 4, the pump 10 may be disposed in a base assembly 42 which is covered by a cap 40. The piston 14 is operably secured to a motor (not shown) which actuates the piston 14. The housing 12 may include a threaded portion 44 to which a sleeve 46 is threadingly engaged. The sleeve 46 provides a uniform mounting surface when the pump housing 12 is mounted in the base assembly 42.

The piston 14 is axially and rotatably slidable within the central longitudinal bore 30 of the piston liner 28. A clearance space 48 exists between the piston and the liner's central bore 30 in order to permit the piston 14 to move smoothly relative to the line liner. This clearance 48 is very small and may be approximately 0.000100". One end of the piston 14 forms a stem 50 that extends out of pump housing open end 26. The opposite end of the piston is formed with a relieved portion 52. As described above, the relieved portion 52 is designed to direct fluid into and out of the pump 10.

With particular reference to FIGS. 1 and 2, a seal assembly 54 is provided at the open end 26 of the pump housing 12 to seal the piston 14 and the housing chamber 20 and to maintain the fluid within the pump housing 12. The seal assembly 54 is secured at the open end 26 of the pump housing 12 by a rigid holder 62. The seal assembly 54 includes a seal body 56 and an elastomeric biasing member 58 which may be in the form of an O-ring. The seal assembly 54 has a central opening 60 to receive the piston stem 50. The seal body 56 includes an outer flange 61 which is held between the holder 62 and a washer 64. The washer 64 has a central opening 65 and is disposed between the seal outer flange 61 and the housing upper end 74 for supporting the seal body 56. The seal body 56 also includes an annular recess 63 for receiving the biasing member 58. The annularly inner-most portion of the seal body is a flexible wall 67 having an end forming a lip seal 69. The biasing member 58 has a diameter larger that the recess 63. Thus when the biasing member 58 is pushed into the recess 63, the biasing member 58 urges the lip seal 69 radially inwardly such that the lip seal 69 sealingly engages the piston 14.

With reference to FIG. 4, the base assembly 42 includes abutment surfaces 66 which engage the holder 62 and thus secure the seal assembly, piston 14 and pump housing 12 together when the cap 40 is secured to the base assembly 42.

A cavity 70 is formed between a liner upper end 72 and the seal assembly 54. The liner upper end 72 is disposed below a housing upper end 74. This creates a space which contributes to the volume of the cavity 70. The washer central opening 65 also creates space contributing to the volume of the cavity 70.

In operation, a motor (not shown) drives the piston 14 to both axially translate and rotate within the liner longitudinal bore 30 to draw liquid into the transverse bore 32 from the inlet port 16 to the outlet port 18. The piston 14 is drawn back as required to take in the desired volume of liquid into the bore 30 of the pump liner 28, thereby producing a negative pressure within the inlet portion 34 of the liner transverse bore 32, which draws in liquid from the inlet port 16. The piston 14 is then rotated to align the relieved portion 52 with the outlet port 18 of the pump housing. The piston is then driven forward the required distance to create a positive pressure to force liquid into the outlet port via the outlet portion 36 of the transverse bore 32 to produce the desired discharge flow.

During operation, fluid may migrate into the clearance 48. Eventually the fluid fills the clearance 48 and reaches the top of the liner 28. The fluid will then pool in the cavity 70. Once the cavity 70 is filled, any extra fluid seeping from the clearance 48 will begin to build pressure in the cavity 70. If this pressure is not relieved, the fluid could start to slip past the seal assembly 54 as the piston 14 moves in and out of the liner 28.

In order to relive the fluid pressure and prevent leakage, a pressure relief passageway 80 is provided to permit the fluid collected in the cavity to be drained therefrom. The passageway provides a fluid communication between the cavity 70 and the input port 16. The passageway 80 may be disposed on the housing chamber sidewall 22 that extends from the inlet port 16 to the cavity 70.

As shown in FIGS. 1-6, in one embodiment the pressure relief passageway 80 may be a channel 82 formed in the housing sidewall surface 25. The channel 82 may be in the form of a groove that is open along its length and exposed to the clearance between the liner and the housing sidewall surface 25. The channel 82 has a top end terminating at the top end of the housing where it is open to the cavity 70. The channel has a lower end 86 which opens to the inlet port 16. Therefore, fluid will flow from the cavity 70 back into the inlet port 16 and through the pump 10 upon operation of the piston. The channel 82 may be formed, for example, by cutting or molding a groove in the housing inner sidewall. Fluid collected in the cavity 70 will flow through the channel 82 into the inlet port 16 due to the pressure differential between the cavity and the inlet port 16 as the piston 14 is actuated.

Figure 9:
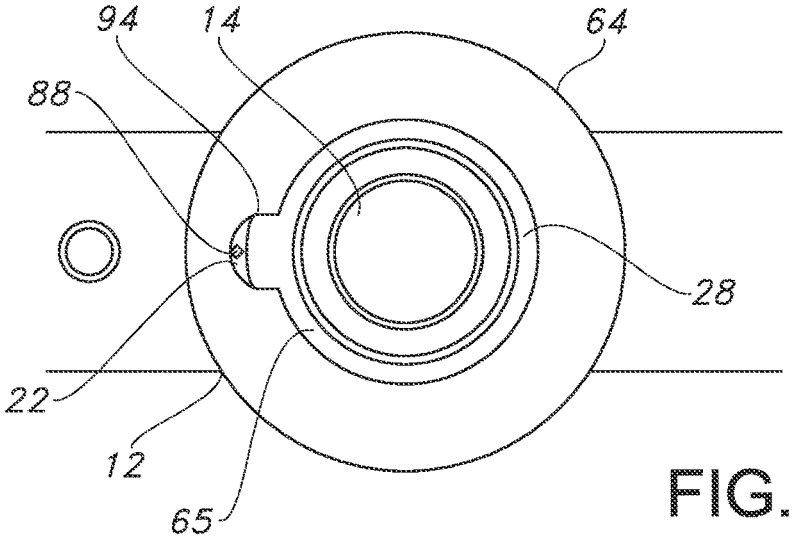
FIG. 9 is a top plan view of the pump embodiment of FIG. 7.
Figure 7:
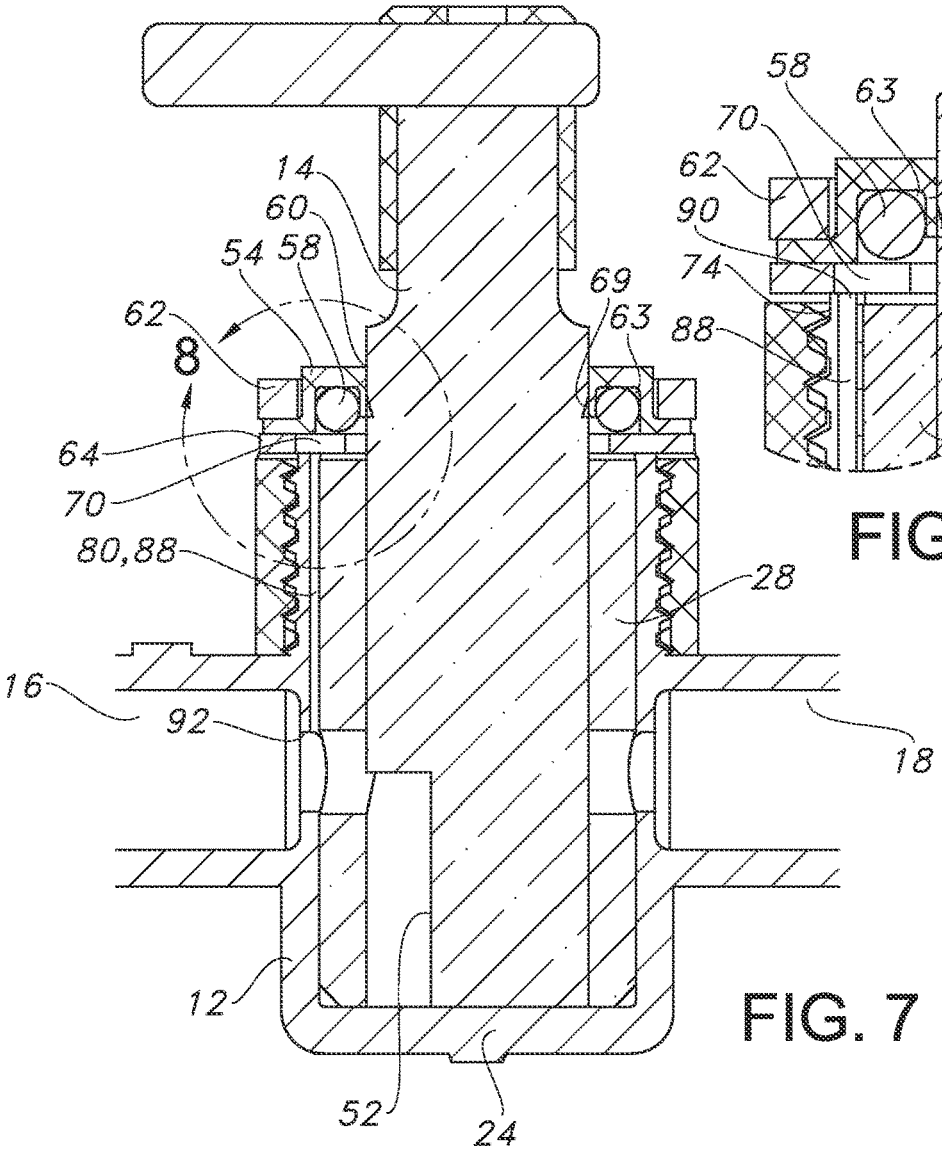
FIG. 7 is cross-sectional view of second embodiment of a fluid pump.
Figure 8:
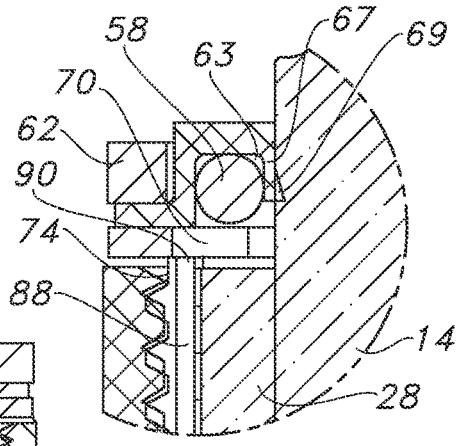
FIG. 8 is a detail cross-sectional view taken from FIG. 7.

An alternative embodiment is shown in FIGS. 7 to 9. The elements of the pump 10 are similar to the embodiment shown in FIGS. 1-6, except that the pressure relief passageway 80 may a duct 88 formed within the housing sidewall 22. The duct 88 may be formed by drilling a through hole in the sidewall 22. The duct 88 is enclosed along its length and open at an opposed first end 90 and second end 92. The duct first end 90 is disposed at the top edge of the housing sidewall and communicates with the cavity 70. The washer 64 may include a notch 94 extending from the central opening 65 to provide a clearance for the duct first end 90. The duct second end 92 is open to and communicates with the inlet port. Thus, a passageway 80 is formed between the cavity and inlet port. By including the passageway in the value housing, the liner wall thickness can be made thinner then if the passageway were formed in the liner. Fluid collected in the cavity 70 will flow through the duct 88 into the inlet port 16 due to the pressure differential between the cavity 70 and the inlet port 16 created by the moving piston 14.

In one exemplary application, the pump 10 of the present disclosure may be used to inject chlorinating solutions, such as Sodium Hypochlorite (NaOCl), into a pressurized water stream frequently encounter problems associated with crystallization of the NaOCl. However, it is contemplated that the pump 10 can be used in any application in which a fluid is to be transported in a controlled manner.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A liquid pump comprising:

a pump housing having a sidewall forming an interior, the housing having an inlet port and an outlet port;

a liner disposed in the interior and having opposed transverse openings in line with the inlet and outlet ports, the liner having a central longitudinally extending bore;

a pump piston axially and rotatably slidable within the liner longitudinally extending bore for pumping a liquid from the inlet port to the outlet port;

a seal assembly secured to the pump housing adjacent to an upper end of the liner, the seal assembly including a seal body, and an upper end of the piston extends through and beyond the seal assembly and is in sealing engagement with the seal body, the seal assembly and liner upper end forming a cavity there between; and the housing interior sidewall having a channel forming a passageway providing a fluid communication between the cavity disposed above the liner upper end and the inlet port.

2. The liquid pump as defined in claim 1, wherein the channel is open to the liner along a length of the channel.

3. The liquid pump as defined in claim 1, wherein the housing has a top end, and the passageway extends between the housing top end and the inlet port.

4. The liquid pump as defined in claim 3, wherein the liner upper end is disposed below the housing top end defining a space.

5. The liquid pump as defined in claim 4, wherein the space contributes to a volume of the cavity.

6. The liquid pump as defined in claim 1, wherein the housing has a rim that extends above the liner upper end and a washer engages the housing rim forming a gap between the washer and the liner upper end, the gap forming part of the cavity and being in communication with the passageway.

7. A liquid pump comprising: a pump housing having a sidewall forming a housing interior, and the housing having an inlet port and an outlet port; a liner disposed in the housing interior and having openings in communication with the inlet and outlet ports, the liner having a central axially extending bore; a pump piston axially and rotatably slidable within the liner central bore for pumping the liquid between the inlet and outlet ports; and the piston, housing, and an upper end of the liner defining a cavity therebetween, the housing including a passageway in the housing interior sidewall, the passageway extending in the axial direction along a length of the interior sidewall and providing fluid communication between the cavity disposed above the upper end of the liner and the inlet port.

8. The liquid pump as defined in claim 7, wherein the liner is disposed between the piston and the housing.

9. The liquid pump as defined in claim 8, wherein the liner upper end is disposed below a housing top end defining a space.

10. The liquid pump as defined in claim 9, wherein the space contributes to a volume of the cavity.

11. The liquid pump as defined in claim 7, wherein the passageway is a channel formed in a surface of the housing interior sidewall.

12. The liquid pump as defined in claim 11, wherein the channel is open to the liner along a length of the channel.

13. The liquid pump as defined in claim 7, wherein the passageway is a duct formed within the housing interior sidewall, the duct having an enclosed sidewall extending along a length of the duct and having a first opening in communication with the cavity and an opposed second end in communication with the inlet port.

14. The liquid pump as defined in claim 7, further including a seal assembly secured to the pump housing adjacent to the upper end of the liner, the seal assembly including a seal body having a recess for receiving a biasing member for urging a portion of the seal body into sealing engagement with the piston.

15. A method for reducing leakage of the liquid pump as defined in claim 7, the method comprising the steps of: creating a negative pressure at the inlet of a pump housing of the pump with a piston axially movable within a liner disposed in a chamber of the pump housing; creating a positive pressure at an outlet of the pump housing with the piston; and transferring liquid from the cavity formed in the pump housing to and from the inlet via the passageway formed in the pump housing extending between the inlet and the cavity.

16. The method as defined in claim 15, wherein the pump housing chamber has a sidewall and the passageway includes a duct formed within the sidewall.

* * * * *